US011031670B2

(12) United States Patent
Langhans et al.

(10) Patent No.: US 11,031,670 B2
(45) Date of Patent: Jun. 8, 2021

(54) ANTENNA ARRANGEMENT

(71) Applicant: Dr. Ing. h.c. F. Porsche Aktiengesellschaft, Stuttgart (DE)

(72) Inventors: Catiuscia Langhans, Stuttgart (DE); Steffen Buchwald, Ingersheim (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 0 days.

(21) Appl. No.: 16/585,395

(22) Filed: Sep. 27, 2019

(65) Prior Publication Data

US 2020/0106153 A1 Apr. 2, 2020

(30) Foreign Application Priority Data

Oct. 2, 2018 (DE) ..... 10 2018 124 277.8

(51) Int. Cl.
*H01Q 1/32* (2006.01)
*H01Q 1/00* (2006.01)

(52) U.S. Cl.
CPC ..... *H01Q 1/005* (2013.01); *H01Q 1/3208* (2013.01); *H01Q 1/3291* (2013.01)

(58) Field of Classification Search
CPC .... H01Q 1/005; H01Q 1/3208; H01Q 1/3291; H01Q 1/40; H01Q 1/20; H01Q 1/325; H01Q 1/3275
See application file for complete search history.

(56) References Cited

U.S. PATENT DOCUMENTS

| | | | | |
|---|---|---|---|---|
| 3,816,837 | A * | 6/1974 | Smith | H01Q 1/3291 343/713 |
| 5,751,251 | A * | 5/1998 | Hutchinson | H01Q 1/32 343/715 |
| 6,201,504 | B1 * | 3/2001 | Aminzadeh | H01Q 1/1271 343/713 |
| 6,351,242 | B1 | 2/2002 | Hesker | |
| 9,954,273 | B2 * | 4/2018 | Shiu | H01Q 1/243 |
| 2013/0106658 | A1 | 5/2013 | Kittinger et al. | |
| 2013/0141269 | A1 | 6/2013 | Schneider et al. | |
| 2015/0116171 | A1 | 4/2015 | Koga et al. | |
| 2020/0243960 | A1 * | 7/2020 | Wittmann | H01Q 1/32 |

FOREIGN PATENT DOCUMENTS

| | | |
|---|---|---|
| CN | 207381528 | 5/2018 |
| CN | 111816976 | 10/2020 |
| DE | 100 25 130 | 11/2001 |
| DE | 10 2009 036 727 | 3/2010 |
| DE | 10 2010 034 073 | 2/2012 |
| DE | 10 2012 219 186 | 5/2013 |
| JP | 2-35803 | 2/1990 |

OTHER PUBLICATIONS

German Search Report dated May 21, 2019.
Great Britain Combined Search and Examination Report dated Jan. 7, 2020.

* cited by examiner

*Primary Examiner* — Tho G Phan
(74) *Attorney, Agent, or Firm* — Gerald E. Hespos; Michael J. Porco; Matthew T. Hespos

(57) ABSTRACT

An antenna arrangement (1) of a motor vehicle (2) with a body component (3) has an antenna (4) received in a recess (5) of a damping element (6), such as a foam component. The antenna (4) with the damping element (6) is attached to the body component (3).

17 Claims, 1 Drawing Sheet

ANTENNA ARRANGEMENT

CROSS REFERENCE TO RELATED APPLICATION

This application claims priority under 35 USC 119 to German Patent Appl. No. 10 2018 124 277.8 filed on Oct. 2, 2018, the entire disclosure of which is incorporated herein by reference.

BACKGROUND

Field of the Invention

The invention concerns an antenna arrangement, in particular a GPS antenna of a motor vehicle.

Related Art

Antennae are arranged at various locations in the motor vehicle. It is known that antennae are integrated for example in a rear window, a front windscreen or a side window. Such antennae are formed solely by a conductor such as a wire that passes through the glass.

Other antennae are for example arranged on the roof or on the tailgate.

DE 100 25 130 A1 discloses the arrangement of an antenna in a body component formed with a plastic superstructure and a reinforcing metal substructure.

DE 10 2009 036 727 A1 discloses the arrangement of an antenna in the region of a panel on a body component.

Thus, the antennae are arranged directly on the body component and are exposed to vibrations during driving or during actuation of the associated body component, such as a tailgate for example. In the long term, this can lead to damage.

It is therefore the object of the present invention to create an antenna arrangement in which the antenna is protected better.

SUMMARY

An antenna arrangement is provided for a motor vehicle with a body component. The antenna arrangement includes an antenna that is received in a recess of a damping element. The antenna with the damping element is attached to the body component. In this way, the antenna can be attached securely and at the same time it is protected from impacts and vibrations.

The damping element may be a foam component, such as a polyurethane foam component.

In certain embodiments, the antenna is formed in a recess of the damping element or foam component as a pre-mounted unit. In this way, the antenna is installed when the damping element or foam component is mounted on the body component, without separate installation of the antenna being required.

The antenna may be received in the damping element or foam component by form fit, substance bonding and/or interference fit. This ensures a good connection of the antenna to the damping element or foam component.

The recess may be configured with a defined undersize relative to the antenna so that the antenna is clamped in the recess. Thus, the antenna can easily be inserted in the recess and securely held there.

In certain embodiments, the antenna with the damping element or foam component is arranged on an underside or an inside of a boot lid or tailgate as a body component. Thus a secure arrangement can be achieved.

A secure arrangement also can be achieved if the antenna with the damping element or foam component is arranged on an underside or inside of a bonnet or front cover as a body component.

The antenna may be a GPS antenna.

The invention is explained in more detail below with reference to an exemplary embodiment shown in the drawing.

DETAILED DESCRIPTION

Figure 1:
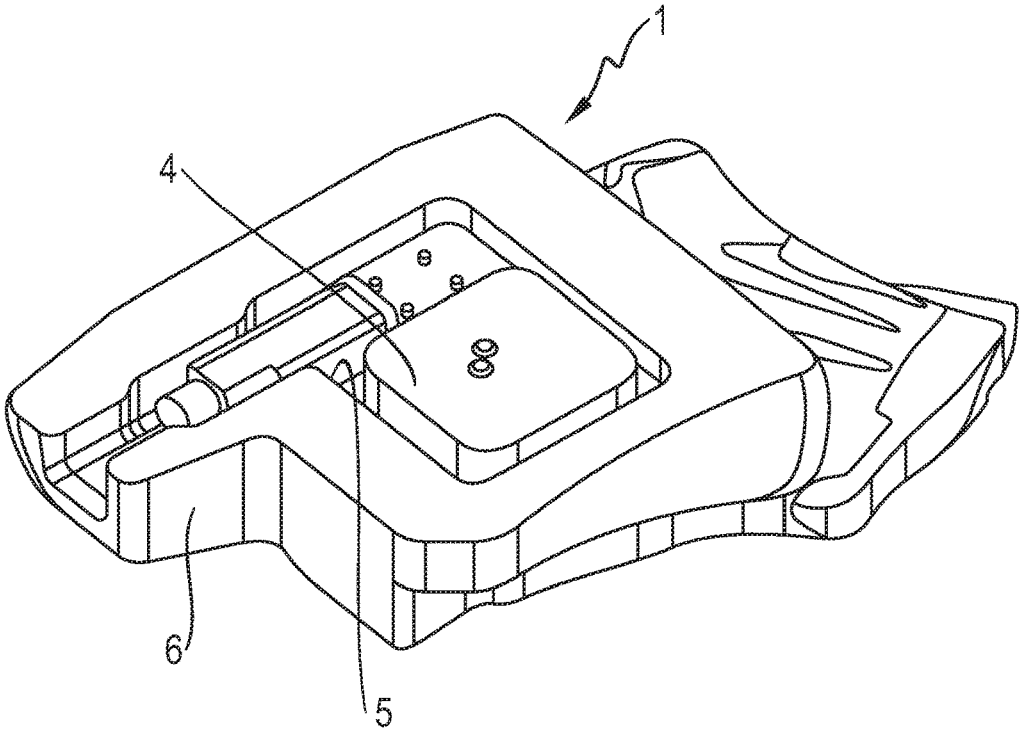
FIG. 1 is a diagrammatic depiction of an antenna in a recess of a damping element.
Figure 2:
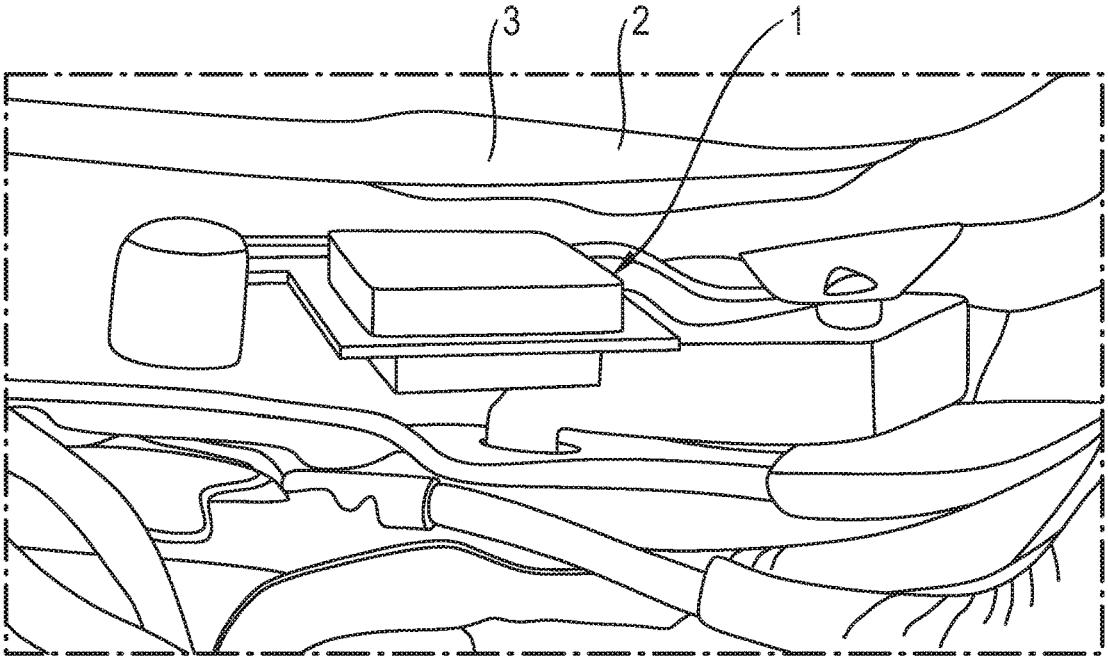
FIG. 2 is a depiction of an antenna arrangement with an antenna according to FIG. 1.

FIG. 1 shows diagrammatically an antenna arrangement 1 of a motor vehicle 2 with a body component 3. The antenna arrangement 1 includes an antenna 4 received in a recess 5 of a damping element 6.

The antenna 4 with the damping element 6 is attached to the body component 3.

The damping element 6 is a foam component, such as a polyurethane foam component or a different foam component from another foam material.

According to FIG. 1, the antenna 4 is formed in the recess 5 of the damping element 6 or foam component as a pre-mounted unit. Thus, the antenna 4 is first inserted in the recess 5 and then the damping element 6 is attached to the body component 3.

The antenna 4 may be received in the damping element 6 or foam component by form fit, substance bonding and/or interference fit. Thus, the antenna 4 may be held in the recess 5 purely by clamping, for example in that the recess 5 is formed with a defined undersize relative to the antenna 4, so the antenna 4 is inserted in the recess 5 and is clamped accordingly in the recess 5 when pressed in.

Alternatively, or additionally, the antenna 4 may be glued in the recess 5 by an adhesive, and/or held by form fit by means of locking means.

In one embodiment, the antenna 4 with damping element 6 or foam component is arranged on an underside or inside of a boot lid or tailgate as a body component 3.

Alternatively, in a further exemplary embodiment, it may also be advantageous if the antenna 4 with damping element 6 or foam component is arranged on an underside or inside of a bonnet or front cover as a body component 3.

Advantageously, the antenna 4 is a GPS antenna.

LIST OF REFERENCE SIGNS

1 Antenna arrangement
2 Motor vehicle
3 Body component
4 Antenna
5 Recess
6 Damping element, foam component

What is claimed is:

1. An antenna arrangement of a motor vehicle, the motor vehicle having a body component, the antenna arrangement comprising: a damping element formed from a foam material and having a recess extending into one side of the damping element; and an antenna received in the recess extending into the one side of the damping element so that the antenna is exposed at the one side of the damping element, wherein the damping element is attached to the body component with the antenna in the recess of the damping element.

2. The antenna arrangement of claim 1, wherein the antenna in the recess of the damping element defines a pre-mounted unit.

3. The antenna arrangement claim 1, wherein the antenna is received in the damping element by form fit, substance bonding and/or interference fit.

4. The antenna arrangement of claim 3, wherein the recess is configured with a defined undersize relative to the antenna so that the antenna is clamped in the recess.

5. The antenna arrangement of claim 1, wherein the antenna with the damping element is arranged on an underside or an inside of a boot lid or tailgate as the body component.

6. The antenna arrangement of claim 1, wherein the antenna with the damping element is arranged on an underside or inside of a bonnet or front cover as the body component.

7. The antenna arrangement of claim 1, wherein the antenna is a GPS antenna.

8. A motor vehicle, comprising:

a body component having an underside;

a damping element formed from a foam material and having a recess extending into one side of the damping element; and an antenna received in the recess extending into the one side of the recess of the damping element so that the antenna is exposed at the one side of the damping element, wherein the damping element is attached to the underside of the body component with the antenna engaged in the recess.

9. The motor vehicle of claim 8, wherein the antenna is received in the damping element by form fit.

10. The motor vehicle of claim 8, wherein the antenna is received in the damping element by substance bonding.

11. The motor vehicle of claim 8, wherein the antenna is received in the damping element by interference fit.

12. The motor vehicle of claim 8, wherein the recess is configured with a defined undersize relative to the antenna so that the antenna is clamped in the recess.

13. The motor vehicle of claim 8, wherein the body component is a boot lid.

14. The motor vehicle of claim 8, wherein the body component is a tailgate.

15. The motor vehicle of claim 8, wherein the body component is a bonnet.

16. The motor vehicle of claim 8, wherein the body component is a front cover.

17. The motor vehicle of claim 8, wherein the antenna is a GPS antenna.

* * * * *